US007691036B1

(12) United States Patent
Julian et al.

(10) Patent No.: US 7,691,036 B1
(45) Date of Patent: Apr. 6, 2010

(54) SUPPORT FOR A FITNESS BALL AND METHOD OF USE

(76) Inventors: Michael K. Julian, 25 Citrus Dr., Palm Harbor, FL (US) 34684; Mark C. Julian, 8605 Woodcrest Dr., Port Richey, FL (US) 34668; Kirby L. Julian, 8605 Woodcrest Dr., Port Richey, FL (US) 34668; Benjamin M. Julian, 8605 Woodcrest Dr., Port Richey, FL (US) 34668

( * ) Notice: Subject to any disclaimer, the term of this patent is extended or adjusted under 35 U.S.C. 154(b) by 0 days.

(21) Appl. No.: 12/154,283

(22) Filed: May 21, 2008

Related U.S. Application Data

(60) Provisional application No. 60/931,456, filed on May 23, 2007.

(51) Int. Cl.
*A63B 21/22* (2006.01)
*A63B 71/00* (2006.01)

(52) U.S. Cl. ..... 482/110; 482/140

(58) Field of Classification Search ..... 482/110, 482/140, 142, 129, 130; 601/52, 60, 67, 601/69, 70; 472/135
See application file for complete search history.

(56) References Cited

U.S. PATENT DOCUMENTS

| | | | | |
|---|---|---|---|---|
| 1,936,022 | A * | 11/1933 | Hunt | 601/110 |
| 3,427,019 | A * | 2/1969 | Brown | 482/77 |
| 4,438,919 | A * | 3/1984 | Gamzo | 472/134 |
| 6,309,331 | B1 * | 10/2001 | Raymond | 482/148 |
| 6,730,005 | B1 * | 5/2004 | Liao | 482/142 |
| 6,746,372 | B2 * | 6/2004 | Hsu | 482/34 |
| 7,288,055 | B2 * | 10/2007 | Blaum | 482/142 |
| 7,437,961 | B2 * | 10/2008 | Dworzan | 74/5.47 |
| 2005/0261114 | A1 * | 11/2005 | Heitzman et al. | 482/142 |
| 2007/0015645 | A1 * | 1/2007 | Hale | 482/140 |

* cited by examiner

*Primary Examiner*—Loan H Thanh
*Assistant Examiner*—Allana Lewin
(74) *Attorney, Agent, or Firm*—Ted Masters

(57) ABSTRACT

A support for holding a fitness ball includes a centrally located vibration assembly. The vibration assembly includes a vibrating plate upon which the fitness ball resides. In an embodiment of the invention the support has arms which receive the fitness ball. Each of the arms has a vibrating member.

1 Claim, 5 Drawing Sheets

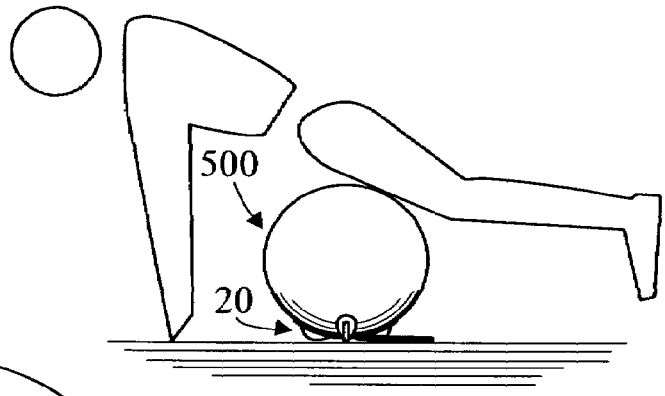
Fig. 7
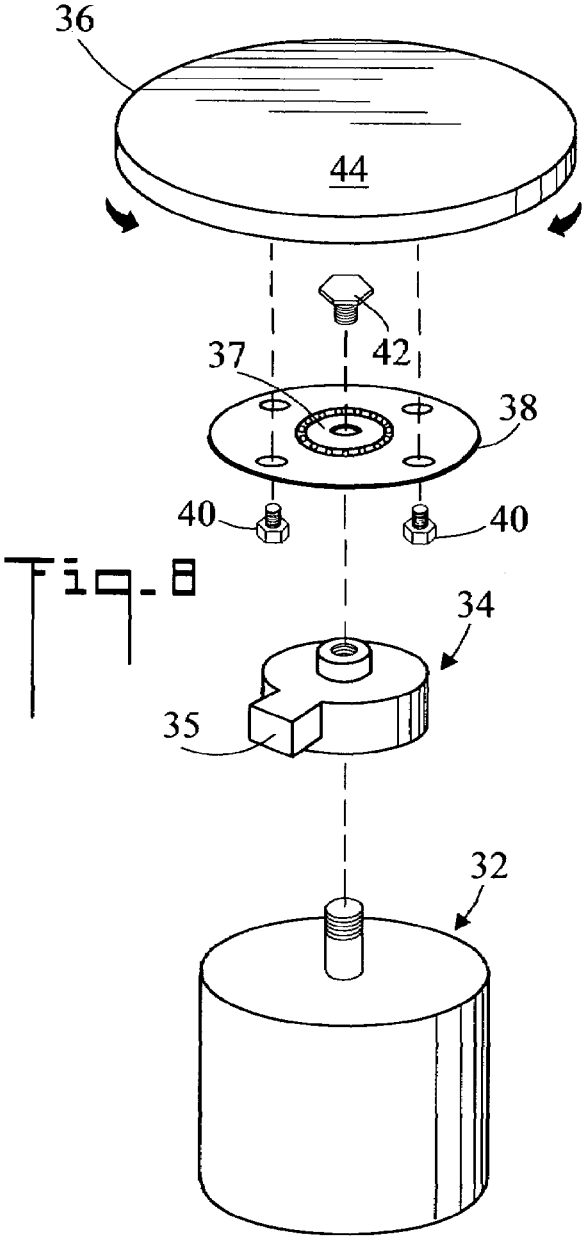
Fig. 8
Fig. 9
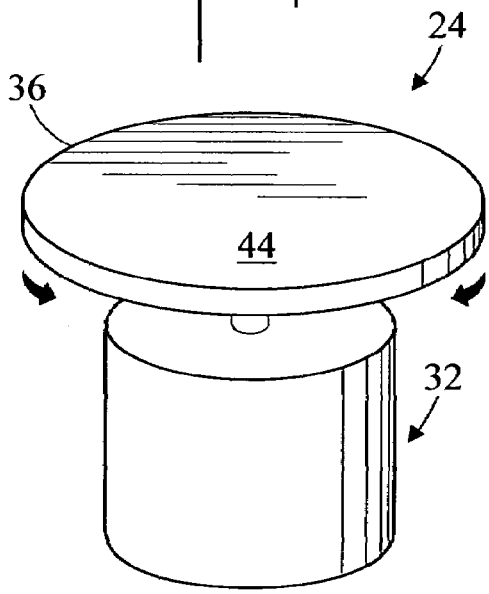

SUPPORT FOR A FITNESS BALL AND METHOD OF USE

CROSS REFERENCE TO RELATED APPLICATION

This application claims the filing benefit under 35 U.S.C. §119(e) of U.S. Provisional Application No. 60/931,456, filed May 23, 2007, which is herein incorporated by reference.

TECHNICAL FIELD

The present invention pertains generally to fitness balls, and more particularly to a vibrating support upon which the fitness ball rests, thereby causing the fitness ball to vibrate.

BACKGROUND OF THE INVENTION

Fitness balls are known by a number of different names including Swiss ball, exercise ball, gym ball, sports ball, fit ball, stability ball, therapy ball, yoga ball, balance ball, or body ball. These balls are light weight, are constructed of an elastic material such as rubber or a polymer, and when inflated with air are usually around 20 to 30 inches in diameter. Fitness balls are used in exercise and physical therapy. Fitness balls should not be confused with medicine balls which are smaller, filled with a packing material rather than air, and heavier.

When a person uses a fitness ball, their body must continually compensate for the instability of the ball and they thereby use many more muscles than in conventional exercise. The abdominal and back muscles particularly benefit from fitness ball exercise. Also, the firmer (more inflated) the ball is the more difficult the exercise will be. Some examples of fitness ball exercises are:

squat and reach
plank
plank with forward lean
reverse crunch
abdominal sit-back
bridge
bridge with heel dig
abdominal ball rise
abdominal ball rotation
side exercise

BRIEF SUMMARY OF THE INVENTION

The present invention is directed to a fitness ball which utilizes vibration to enhance the benefits of the exercise. Vibration makes the body's fast twitch muscles and slow twitch muscles operate at the same time increasing the stress on the muscles and increasing the demand put on them. As a result, a 10 minute workout with vibration is equivalent to a 60 minute workout with out vibration. Vibration used in conjunction with the fitness ball significantly reduces the work out time and results in a more effective exercise.

The vibration of the fitness ball is effected by installing the ball on a vibrating support. In accordance with a preferred embodiment of the invention, the support includes a body shaped and dimensioned to receive the fitness ball, the body having a central portion. A vibration assembly is disposed in the central portion of the body.

In accordance with an aspect of the invention, the vibration assembly includes an electric motor which is connected to an eccentric member having an off-center weight. When the motor turns the eccentric member causes vibrations. A plate is connected to the eccentric member so that the plate freely rotates with respect to the eccentric member. When the fitness ball is placed in the support, the fitness ball resides upon the plate.

In accordance with another aspect of the invention, the plate has a friction enhancing surface so that it clings to the fitness ball.

In accordance with another aspect of the invention, the body includes a plurality of arms which receive the fitness ball.

In accordance with another aspect of the invention, each of the plurality of arms has a vibrating member.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 7 is a reduced side elevation view of a person using the fitness ball which has been placed in the support;

FIG. 8 is an enlarged exploded perspective view of a vibration assembly;

FIG. 9 is an enlarged perspective view of the vibration assembly;

DETAILED DESCRIPTION OF THE INVENTION

Figure 1:
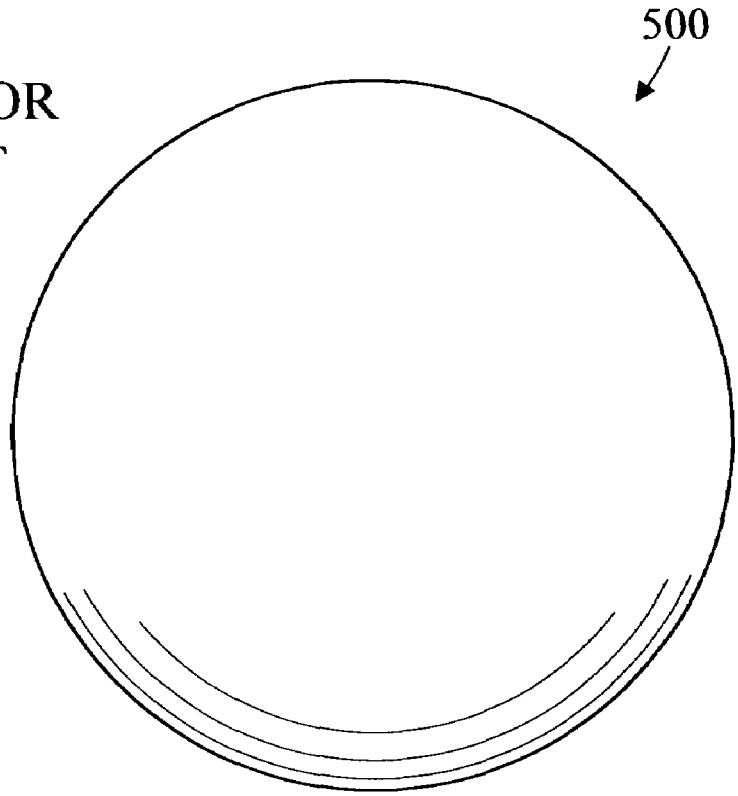
Fig. 1 PRIOR ART
FIG. 1 is a side elevation view of a prior art fitness ball.
Figure 2:
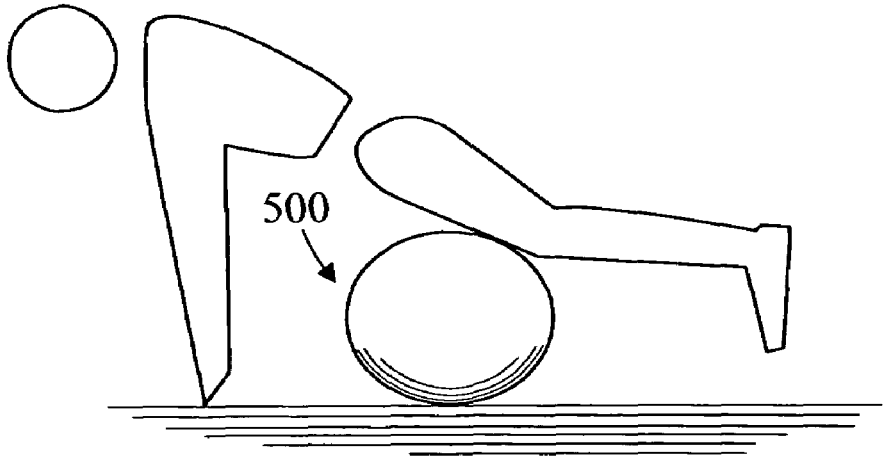
Fig. 2 PRIOR ART
FIG. 2 is a reduced side elevation view of a person using the fitness ball to do a plank exercise.

Referring initially to FIG. 1, there is illustrated a prior art fitness ball 500. FIG. 2 is a side elevation view of a person using fitness ball 500, which is disposed on a support surface such as a floor, to do a plank exercise. It may be appreciated that numerous other exercise postures may be used with fitness ball 500 as are well known in the exercise art.

Figure 3:
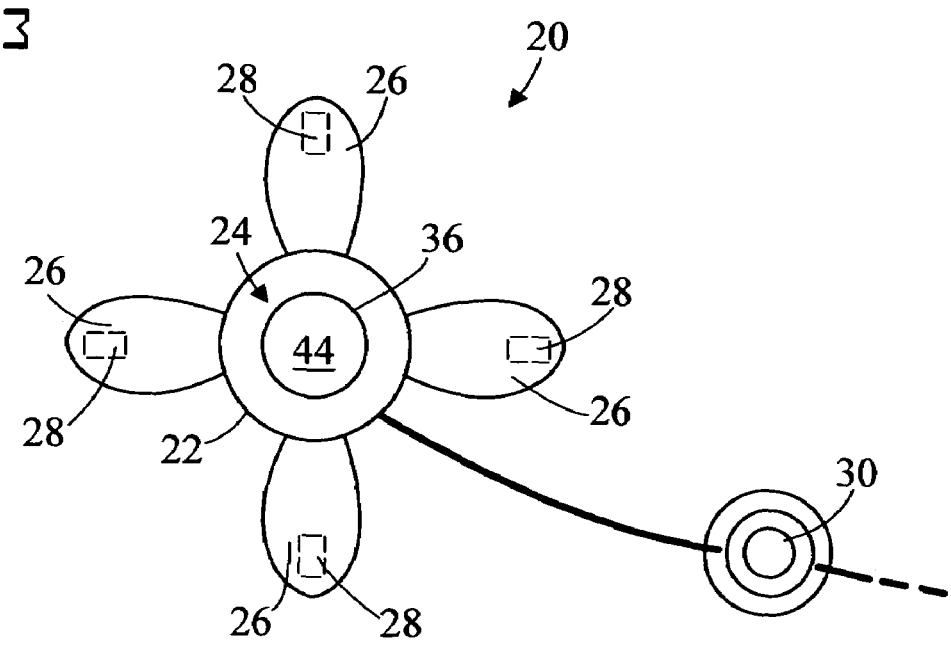
FIG. 3 is a top plan view of a support for a fitness ball in accordance with the present invention.
Figure 4:
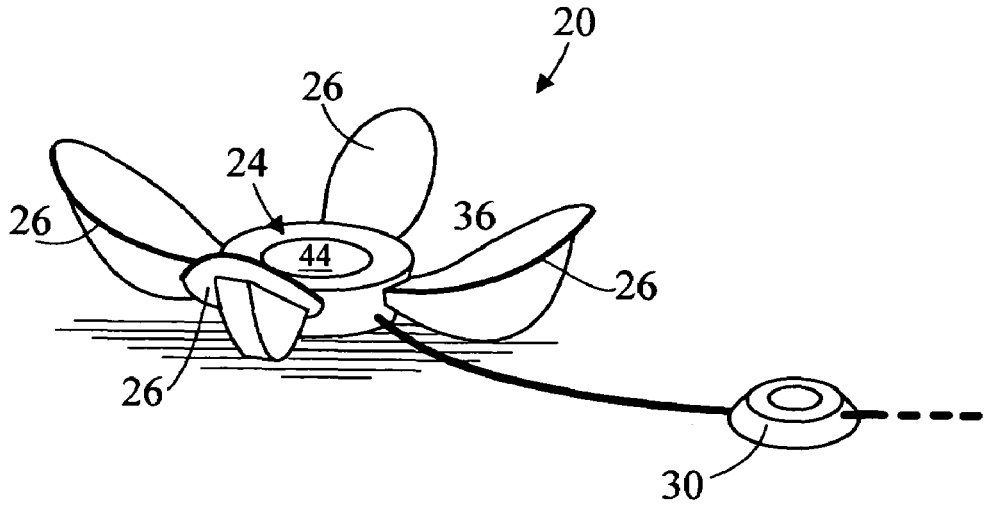
FIG. 4 is a perspective view of the support.

Now referring to FIGS. 3-4, there are illustrated top plan and perspective views respectively of a support for fitness ball 500 in accordance with the present invention, generally designated as 20. Support 20 includes a body 22 shaped and dimensioned to receive fitness ball 500, body 22 has a central portion. A vibration assembly 24 is disposed in the central portion of body 22. Body 22 includes a plurality (four in the shown embodiment) of outwardly extending arms 26 which receive fitness ball 500. Arms 26 are curved to match the curvature of fitness ball 500. In an embodiment of the invention, each of the plurality of arms 26 has a vibrating member 28, which in the shown embodiment include DC electric motors which have an eccentric member which causes the motors to vibrate when they rotate. In the shown embodiment, support 20 is powered with conventional AC power, and includes a control 30 (such as a foot switch) for selectively activating vibration assembly 24 and vibrating members 28.

In other embodiments of the invention, control 30 may also be used to change the vibration intensity, frequency, speed, mode, or the like.

Figure 5:
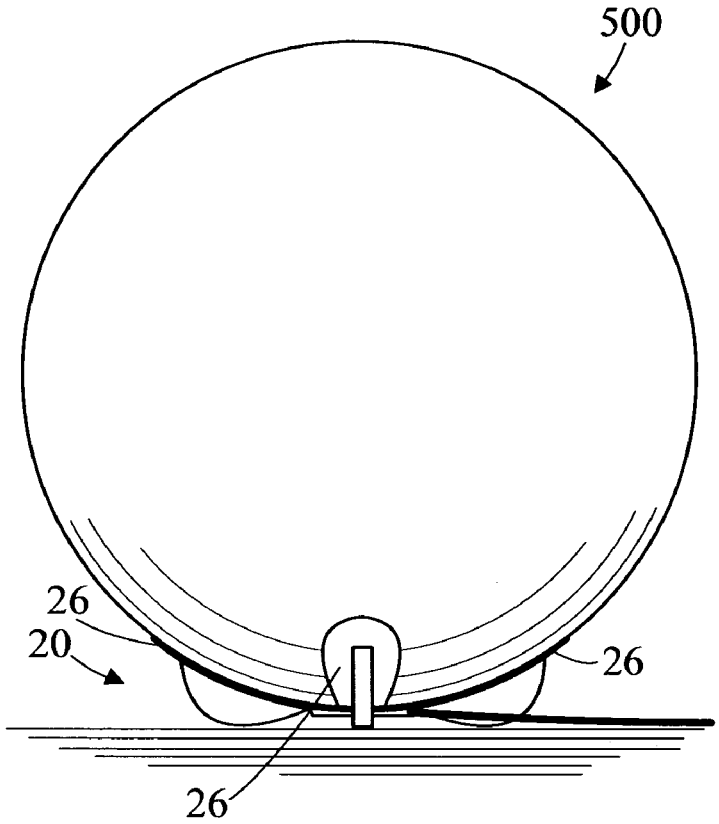
FIG. 5 is a side elevation view of the fitness ball received by the support.

FIG. 5 is a side elevation view of fitness ball 500 received by arms 26 of support 20. Because vibration assembly 24 (refer to FIGS. 3, 4, 8, and 9) is located in the center of body 22, when fitness ball 500 is placed in support 20 it resides upon vibration assembly 24.

Figure 6:
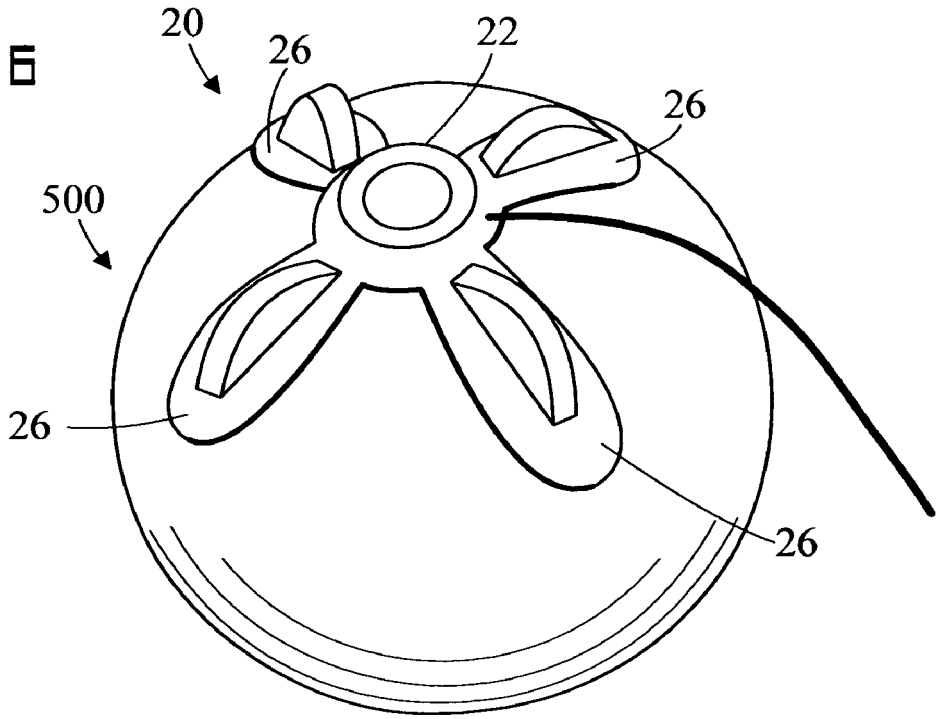
FIG. 6 is a bottom perspective view of the fitness ball received by the support.

FIG. 6 is a bottom perspective view of fitness ball 500 received by support 20 showing body 22 and arms 26.

FIG. 7 is a reduced side elevation view of a person using fitness ball 500 which has been placed in support 20.

FIG. 8 is an enlarged exploded perspective view of vibration assembly 24. Vibration assembly 24 includes an electric motor 32 which is connected to an eccentric member 34. Eccentric member 34 includes an off center weight 35 which causes vibration when eccentric member 34 is turned by motor 32. That is, the weight of eccentric member 34 is not evenly distributed about the axis of rotation of motor 32, and as such causes vibration when motor 32 rotates at speeds as high as 4,000 rpm. A plate 36 is connected to eccentric member 34 so that plate 36 freely rotates with respect to eccentric member 34. In the shown embodiment the connection of plate 36 to eccentric member 34 is effected by a connection plate 38 which is fixedly connected to plate 36 with retainers 40 which engage inserts (not shown) in plate 36. Connection plate 38 rotates about a central ball bearing 37 which is connected to eccentric member 34 with a connector 42. That is, the outside portion of connection plate 38 is not fixedly connected to eccentric member 34, but can freely spin clockwise or counterclockwise about bearing 37. Since connection plate 38 freely spins, so does plate 36 to which it is connected.

When fitness ball 500 is placed in support 20, fitness ball 500 resides upon plate 36. Plate 36 has a friction enhancing surface 44, which tends to cling to fitness ball 500. In the shown embodiment plate 36 is fabricated from rubber.

FIG. 9 is an enlarged perspective view of vibration assembly 24, showing rotating plate 36 and motor 32.

In terms of use, a method for a user to use a fitness ball includes:

(a) providing a fitness ball 500;

(b) providing a support 20 for fitness ball 500 including:

a body 22 shaped and dimensioned to receive fitness ball 500, body 22 having a central portion;

a vibration assembly 24 disposed in the central portion of body 22;

(c) placing fitness ball 500 in support 20;

(d) activating vibration assembly 24, thereby causing fitness ball 500 to vibrate; and, (e) the user using fitness ball 500.

The method further including:

in step (b), vibration assembly 24 including:

a motor 32;

an eccentric member 34 connected to motor 32;

a plate 36 connected to eccentric member 34 so that plate 36 freely rotates with respect to eccentric member 34; and, in step (c), placing fitness ball 500 upon plate 36.

The method further including:

in step (b), plate 36 having a friction enhancing surface.

The method further including:

in step (b), body 22 including a plurality of arms 26 which receive fitness ball 500 in step (c), each of the plurality of arms having a vibrating member 28; and, in step (d), the activating including activating vibrating members 28.

Figure 10:
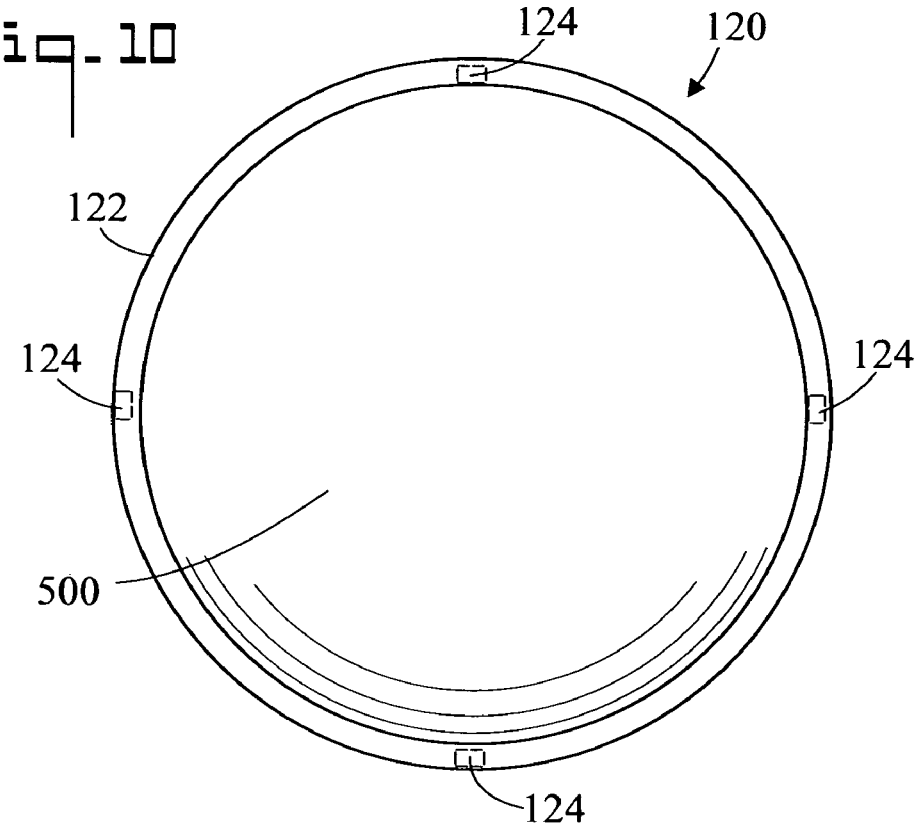
FIG. 10 is a top plan view of a second embodiment of the invention receiving a fitness ball; and, FIG. 11 is a side elevation view of the second embodiment receiving the fitness ball.
Figure 11:
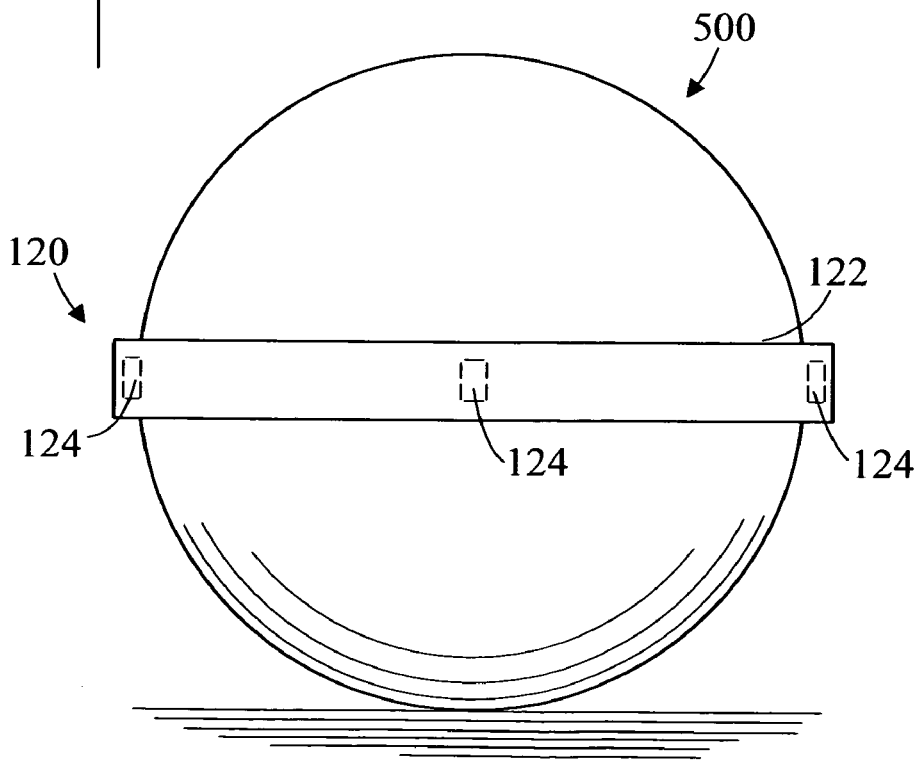

FIGS. 10 and 11 are top plan and side elevation views respectively of a second embodiment of the invention, generally designated as 120, receiving a fitness ball 500. Apparatus 120 includes a band 122 shaped and dimensioned to encircle fitness ball 500. A plurality of vibrating members 124 (four in the shown embodiment) are disposed in band 122. The plurality of vibrating members 124 are evenly spaced around the circumference of band 122.

The preferred embodiments of the invention described herein are exemplary and numerous modifications, variations, and rearrangements can be readily envisioned to achieve an equivalent result, all of which are intended to be embraced within the scope of the appended claims.

We claim:

1. A support for a fitness ball, comprising:

a body shaped and dimensioned to receive the fitness ball, said body having a central portion;

a vibration assembly disposed in said central portion of said body;

said vibration assembly including:

a motor;

an eccentric member connected to said motor;

a plate connected to said eccentric member so that said plate freely rotates with respect to said eccentric member;

when the fitness ball is placed in said support, the fitness ball resides upon said plate;

said plate having a friction enhancing surface;

said body including four arms which receive the fitness ball; and, each of said four arms having a vibrating member.

* * * * *